US005868243A

United States Patent [19]

Bächle

[11] Patent Number: 5,868,243

[45] Date of Patent: Feb. 9, 1999

[54] SAFETY SWITCH ASSEMBLIES

[75] Inventor: Erik Bächle, Filderstadt, Germany

[73] Assignee: Euchner & Co., Leinfelden-Echterdingen, Germany

[21] Appl. No.: 913,939

[22] PCT Filed: Jan. 9, 1997

[86] PCT No.: PCT/EP97/00061

§ 371 Date: Sep. 22, 1997

§ 102(e) Date: Sep. 22, 1997

[87] PCT Pub. No.: WO97/27603

PCT Pub. Date: Jul. 31, 1997

[30] Foreign Application Priority Data

Jan. 26, 1996 [DE] Germany ..... 196 02 690.3

[51] Int. Cl.[6] ..... H01H 27/00

[52] U.S. Cl. ..... 200/334; 200/17 R; 200/61.62; 200/43.07

[58] Field of Search ..... 200/17 R, 43.01, 200/43.04–43.09, 61.62–61.68, 334

[56] References Cited

U.S. PATENT DOCUMENTS 4,963,706 10/1990 Mohtasham ..... 200/334
5,464,954 11/1995 Kimura et al. ..... 200/61.62
5,516,993 5/1996 Wecke et al. ..... 200/17 R
5,587,569 12/1996 Mohtasham ..... 200/17 R

*Primary Examiner*—Michael A. Friedhofer
*Attorney, Agent, or Firm*—Michael J. Striker

[57] ABSTRACT

A safety switch for a guard device associated with a machine or a device, the safety switch has a switch housing, a switch head connected to the switch housing and having a drive device actuatable by a key insertable into and removable from the switch head, a switch actuating device which is displaceable counter to a restoring force into a position corresponding to a first switch position by an actuating force generated by the drive device and without this actuating force exerted by the restoring force assumes a position corresponding to a second switch position, a sensor detecting a presence and an absence of the switch head, and an actuator arranged in the switch housing and operating so that under a control of the sensor in the event of loosening of the switch head from the switch housing exerts a force on the switch actuating device in a direction of motion to the restoring force, that is equal to or greater than the restoring force, depending on whether the switch actuating device is to be held in a previously assumed position or is to be returned thereto.

11 Claims, 4 Drawing Sheets

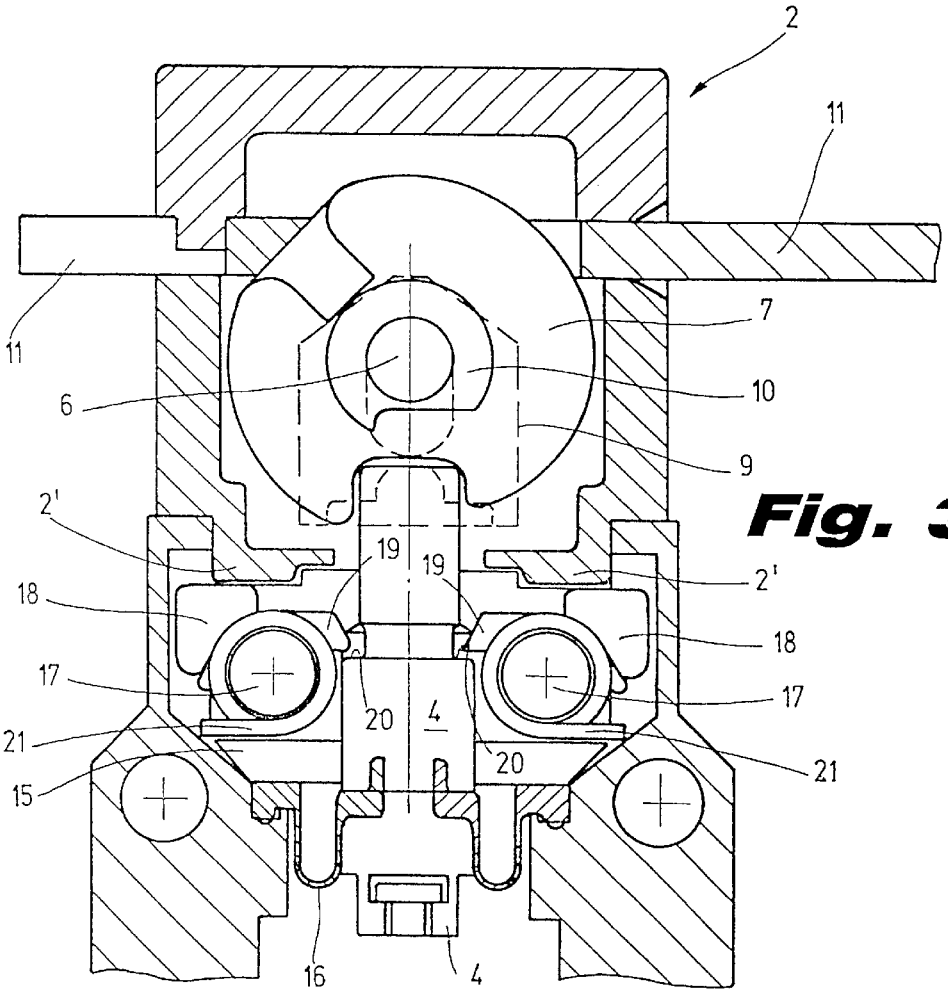
Fig. 3
Fig. 4
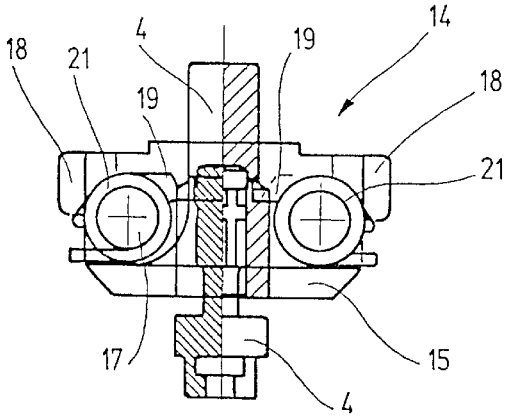
Fig. 5
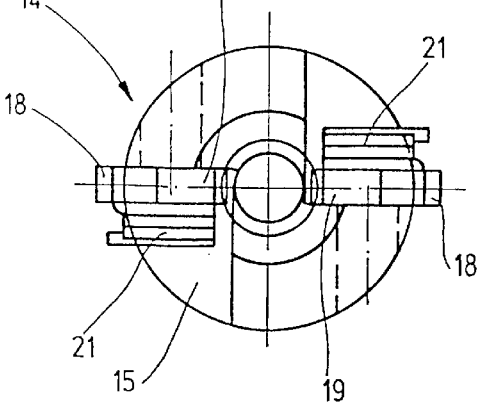

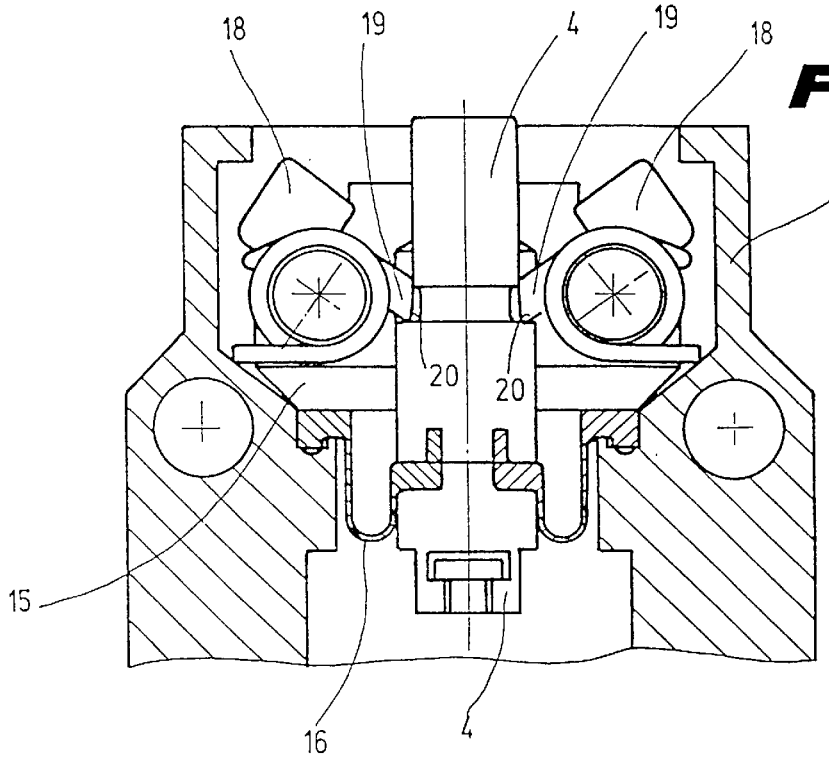
Fig. 6
Fig. 7
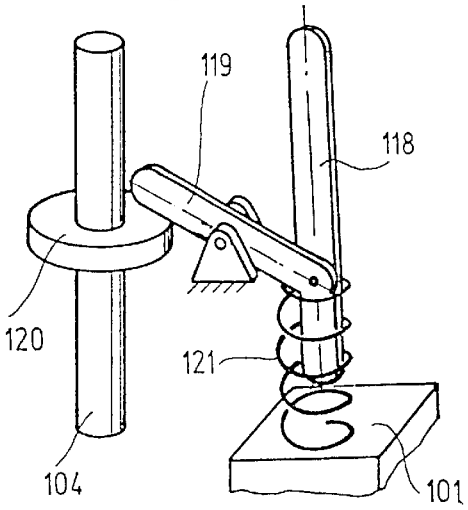
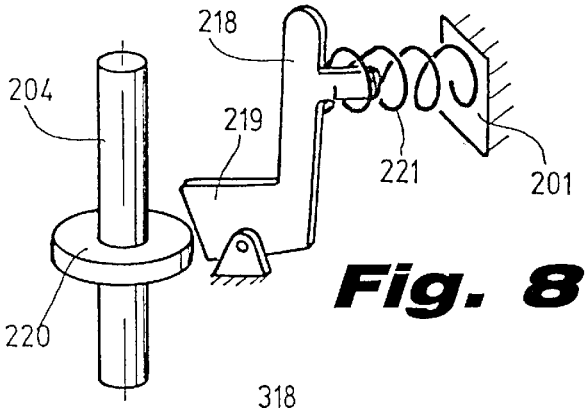
Fig. 8
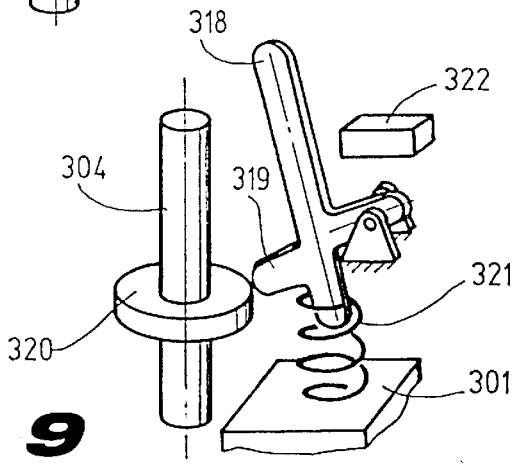
Fig. 9

SAFETY SWITCH ASSEMBLIES

BACKGROUND OF THE INVENTION

The invention relates to a safety switch for a guard device associated with a machine or device.

Guard devices of this type prevent persons from being able to get within the danger range of a machine or device as long as the machine or device is in operation. To that end, the door or the like that allows access is monitored by a safety switch, which allows the machine or device to be turned on only if the door or the like is closed, and which stops the machine or device if the door or the like is opened.

The known safety switches of the type referred to at the outset are actuated by means of a key, which can be introduced into a channel provided in the head of the switch and removed from it again. Both when the key is inserted into the switch head and when it is removed, a switchover of the switch takes place, in the one case preferably by compulsion, because of the force exerted on the key.

The known safety switches have the serious disadvantage that whenever the switch head comes loose from the switch housing, especially in response to externally exerted force, breakage occurs that causes disconnection; the tappet of the safety switch, because of the restoring force exerted on it, changes over to the switching state in which the machine or device can either be turned on or stays on. If the disconnection of the switch head from the switch housing occurs when the door or the like of the guard device is open or is being opened, then the protection sought by means of the guard device and the safety switch is entirely lacking.

SUMMARY OF THE INVENTION

It is therefore the object of the invention to create a safety switch of the type referred to at the outset that does not lose its safety function even if the switch head is disconnected from the switch housing. In accordance with the invention a sensor that detects the presence and absence of the switch head is provided, and an actuator is arranged in the switch housing under the control of the sensor and, in the event of loosening of the switch head from the switch housing, exerts a force on the switch actuating device in direction of motion counter to the restoring force, that is equal to or greater than the restoring force, depending on whether the switch actuating device is to be held in its previously assumed position or is to be returned thereto.

Thanks to the sensor that detects the presence and/or absence of the safety switch and to the actuator, disposed in the switch housing and controlled by this sensor, it is possible, if the switch head is disconnected from the switch housing, for the actuator to exert a force on the switch actuating device, on whose position the switching position of the switch depends, that either puts the switch in the OFF position or prevents the switch from changing over to the position in which the machine or device is, or can be, put into operation.

In a preferred embodiment, the sensor has at least one mechanical feeler member. It is understood that other sensors, such as optical or electrical sensors, can also be considered.

In the case of the actuator as well, a mechanical version is advantageous, for reasons of both cost and reliability; it is expedient for the actuating force to be made available by a spring loader. However, the actuator may also have or comprise other components, such as electromagnetic components.

In a mechanical version of the actuator, an embodiment of the force transmitting member as a pivot lever, in whose pivot path a stop face of the switch actuating device is located, is especially advantageous.

In the case of a mechanical feeler member, this member is preferably embodied as a barrier element that, when there is a switch head, keeps the force transmitting member in its inactivated state and does not enable it until the feeler member ascertains the separation of the switch head from the switch housing.

The actuator is especially simple and space-saving if the feeler member is formed by one arm, and the force transmitting member by the other arm, of a double-armed lever. In that case, a spring forming the spring loader can wraps around a bearing trunnion serving to support the double-armed lever and can be supported by one end on the switch housing and by its other end on the double-armed lever.

In a preferred embodiment, at least two force transmitting members, advantageously embodied identically, are provided, which are disposed on the switch housing, distributed over the circumference of the switch actuating device, advantageously symmetrically to the switch actuating device.

The supporting of the force of the spring loader on the switch head can be selected to meet the needs involved. If a support such that the force or the main force component oriented transversely to the direction of motion of the switch actuating device, puts an excessive load on the typically screw-type connection of the switch head to the switch housing, as may happen for instance in the case of a plastic switch housing with threaded bores machined into it, then the support can also be provided such that the force or main force component is oriented in the radial direction of the tappet.

The invention is described in detail below in terms of exemplary embodiments shown in the drawing.

BRIEF DESCRIPTION OF THE DRAWINGS

FIG. 3: a fragmentary longitudinal section through the first exemplary embodiment with the key inserted into the switch head;

FIG. 4: a view, shown partly in section, of the actuator of the first exemplary embodiment and the part of the tappet actuated by the actuator when the switch head is present;

FIG. 5: a plan view on the actuator of FIG. 4;

FIG. 6: a fragmentary longitudinal section through the first exemplary embodiment with the switch head missing;

FIG. 7: a fragmentary, schematic illustration of a second exemplary embodiment;

FIG. 8: a fragmentary, schematic illustration of a third exemplary embodiment;

FIG. 9: a fragmentary, schematic illustration of a fourth exemplary embodiment;

DESCRIPTION OF PREFERRED EMBODIMENTS

Figure 1:
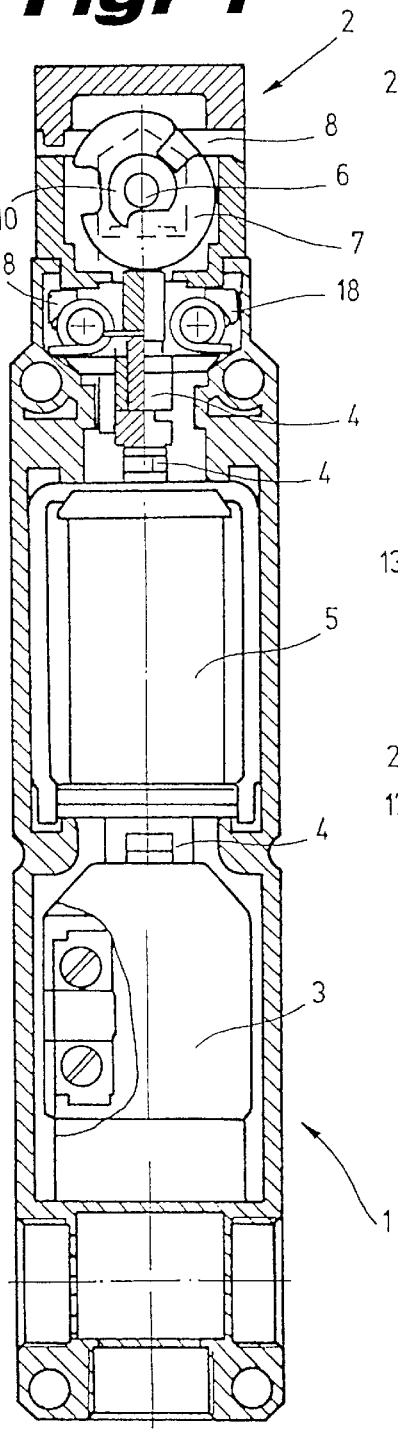
FIG. 1: enlarged longitudinal section through a first exemplary embodiment without an associated key.

As FIG. 1 shows, a safety switch for a guard device associated with a machine or device, the guard device having a door or the like which in the closed state prevents a person from being able to get within the danger range of the machine or device, has a parallelepiped switch housing 1, which in the exemplary embodiment is of plastic but which could also be of metal. One end of the switch housing 1, the upper end in terms of FIG. 1, is adjoined by a switch head 2, which is connected to the switch housing 1 via screws, not shown. The switch housing 1, fixed for example to the stationary frame of the door or guard device to be monitored, includes a switch 3 that is located in the control current circuit of the machine or device. For the actuation of the switch 3, a tappet 4 is supported longitudinally displaceably in the switch housing 1; it extends from the switch 3 toward the switch head 2 and penetrates a magnet coil 5 fixedly disposed in the switch housing 1. The portion of the tappet 4 that penetrates this magnet coil 5 is embodied as an armature over part of its length; when the magnet coil 5 is excited, the armature is pulled into the magnet coil 5 toward the switch 3, counter to the force of a restoring spring, not shown, and held in that position. The magnet coil 5 is needed only if there is a need to prevent the possibility that the door or the like can be opened immediately after the machine or device is turned off. If there is no need for the safety switch to continue blocking the door or the like for a certain period of time after the machine or device has been turned off, then the magnet coil 5 can be omitted, without otherwise impairing the function of the safety switch.

An eccentric disk 7, which protrudes into a key channel 8 that penetrates the switch head 2, is rotatably supported on a shaft 6 that intersects the longitudinal axis of the tappet 4 at a right angle One slide 9, displaceable in the longitudinal direction of the tappet 4, is disposed on each of the two sides of the eccentric disk 7 and is provided with an oblong slot through which the shaft 6 can pass. The two slides 9, whose gable-like upper end portions each likewise protrude into the key channel 8 when the slides 9 are in the barrier position in which springs, not shown, seek to hold them, each cooperate with one cam disk 10 that is connected in a manner fixed against relative rotation to the eccentric disk 7 and that secures the slides, in their barrier position, against counterclockwise rotation, in terms of FIGS. 1 and 2, of the eccentric disk 7, in order to prevent the safety switch from being actuatable by any means other than its assigned key 11, which is disposed on the guard device door to be monitored in such a way that it enters the key channel 8 when the door is closed. The key 11 is embodied such that on entering the key channel 6, it first displaces the two slides 9 so far toward the switch housing 1 that they release the cam disks 10, and thus the eccentric disk 7 as well, to rotate clockwise in terms of FIGS. 1 and 2. A cross member of the key 11 then comes into engagement with a groove 12 of the eccentric disk 7 and rotates the latter into the angular position shown in FIG. 3.

In this angular position, the upper end of the tappet 4, which before the key 11 is inserted into the key channel 8 rests on a raised portion of the control curve formed by the circumference of the eccentric disk 10, can drop into a second groove 13 of the eccentric disk 7 that forms a low portion of the control curve. Both the contact of the tappet end with the raised portion of the control curve and the dropping into the second groove 13 with the attendant longitudinal displacement of the tappet 4 are effected by the prestressed spring that acts upon the tappet 4. In this longitudinal displacement of the tappet 4, the switch changes from its opened state to its closed state, so that, with the door closed, the machine or device can be put into operation.

The sides of the second groove 13 are so steep that the end of the tappet cannot be moved out of the second groove 13 by a rotation of the eccentric disk 7. The blockage of the control disk 7 prevents the key 11 from being removable from the key channel 7 and prevents the door that is to be secured from being openable as long as the machine or device is in operation, and accordingly as long as access to it must be precluded. Not until the machine or device is turned off, and preferably not until it has also come to a complete stop, is the magnet coil 5 excited; this causes the tappet 4 to move far enough in the opening direction of the switch 3, or in other words downward in terms of FIGS. 1–3, that the end of the tappet releases the eccentric disk 7. Only now can the key 11 be pulled out of the key channel 8, and only now can the door or the like that has the key 11 be opened. Thanks to the raised portion of the control curve of the eccentric disk 7, the magnet coil 5 can be turned off as soon as the tappet 4 can be retained, by the raised portion of the control curve, in the position that keeps the switch 3 in the opened state.

Figure 2:
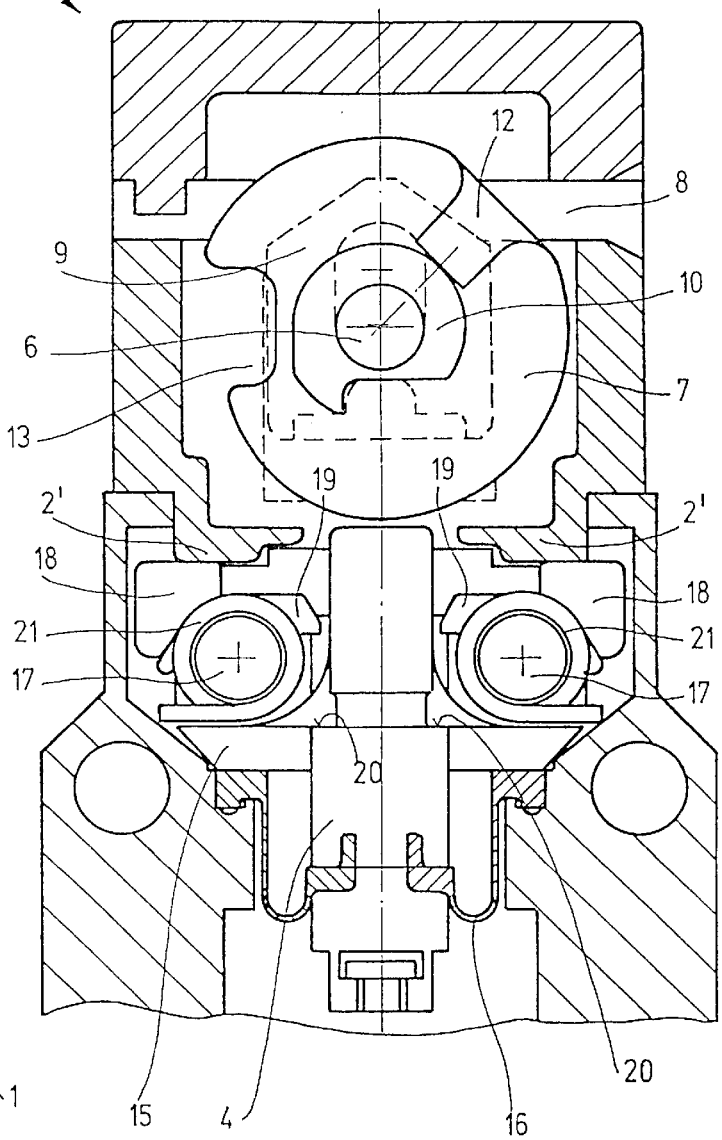
FIG. 2: a detail of FIG. 1 shown on a larger scale.

Inserted into the end portion of the switch housing 1 adjacent the switch head 2 is an actuator, identified overall by reference numeral 14, which has a carrier 15 that has a central through opening for the tappet 4. The carrier 15 is fixedly connected to the switch housing 1. A roll diaphragm seal 16 contacting its underside is tightly joined on the other side to the tappet 4 and thereby protects the interior of the switch housing 1 from invasion by external factors that could cause problems. Located diametrically to the through opening for the tappet, the carrier 5 has two bearing trunnions 17, at the same level and parallel to one another, extending toward the shaft 6; one double-armed pivot lever of the actuator 14 is rotatably supported on each of these trunnions. As FIG. 5 shows, the two pivot levers are located in the same radial plane, which is also the plane in which the longitudinal axis of the tappet 4 is located. The two arms of the pivot lever pointing away from one another each form one feeler member 18; as particularly shown in FIGS. 2 and 3, as long as the switch head 2 is properly connected to the switch housing 1 and rests on it, each feeler member rests on the face toward the actuator 14 of a respective material portion 2' of the switch head 2. In this angular position of the feeler member 18, the other arm, forming a force transmitting member 19, of each of the two pivot levers extends toward the tappet 4. The free end of each of the two force transmitting members 19, as shown in FIGS. 2 and 3, extends over a respective stop face 20 formed by one shoulder of the tappet 4. If, as shown in FIG. 3, the upper end of the tappet 4 is in engagement with the second groove 13, or in other words if the switch 3 is in the closed state, then the stop face 20 of the tappet 4 is spaced only slightly apart from the force transmitting members 19 and is within pivoting range of them.

A torsion spring 21 is disposed on each of the two bearing trunnions 17 of the actuator 14; it is braced on one end against the carrier 15 and on the other against the feeler member 18. The two prestressed torsion springs 21 not only have the task of keeping the feeler member 18 in contact with the associated material portion 2' of the switch head 2, from which it can then pivot into a different angular position, shown in FIG. 6, if for any reason the switch head 2 separates from the switch housing 1. In addition, in such a case, both the force transmitting members 19, which in the aforementioned pivoting motion of the feeler members 18 come into contact with the stop face 20, must displace the tappet 4 toward the switch 3, in order to open the switch. The force of the two torsion springs 21 together must therefore be greater than the force of the restoring force acting on the tappet 4. As FIG. 6 shows, the two force transmitting members 19 remain in contact with the stop face 20 and thereby keep the switch 3 in the opened state, in which the machine or device is stopped or cannot be turned on. Although the monitored door of the guard device can be opened if the switch head 2 has separated from the switch housing 1, still there can be no danger to human beings, because of the opening of the switch 3 by the actuator 14.

Instead of a feeler member in the form of a pivot lever, it is possible for instance, as the exemplary embodiment of FIG. 7 shows, to provide a feeler member 118 in the form of a bar that is disposed, longitudinally displaceably, parallel to the tappet 104 in the switch housing. The translational motion of the feeler member 118 can be transmitted, for instance by means of a force transmitting member 119 in the form of a double-armed pivot lever, to the tappet 104, which as in the first exemplary embodiment is provided with a stop face 120 which can be contacted by the free end of the force transmitting member 119. The contact of the feeler member 118 with a material portion of the switch head and, if the latter should come loose from the switch housing, the displacement of the tappet 104 into the position corresponding to the opened position of the switch is accomplished, as in the first exemplary embodiment, by means of a spring loader, which is formed for instance by a prestressed helical compression spring 121, which is supported by one end on the feeler member 118 and by the other on the switch housing 101.

The load put on the screws or other fasteners that connect the switch head to the switch housing by the force of the spring or springs forming the spring loader of the actuator can be reduced by providing a bell crank, for instance, one arm of which forms the feeler member 218 and the other arm of which forms the force transmitting member 219. A spring 221 forming the spring loader urges the feeler member 218 transversely to its longitudinal direction, as FIG. 8 shows. The bar-like feeler member 218 then, when it rests on the switch head, forms an acute angle with the longitudinal axis of the tappet 204. If the switch head comes loose from the switch housing, then the spring 221, braced on the switch housing 201 laterally beside the feeler member 218, pivots the feeler member 218 counterclockwise, in terms of FIG. 2, toward the tappet 204. As a consequence of this pivoting motion, the force transmitting member 219 comes to rest on the stop face 220 of the tappet 204 and moves it into the position in which the switch is opened. The force transmitting member 218 could extend over the stop face 220, as shown in FIG. 7. In this exemplary embodiment, however, it comes into contact with the edge of the stop face 220 by its face end that extends at an acute angle to the longitudinal axis of the tappet 204, and as a result once again a force oriented toward the switch is exerted on the tappet 204.

In the fourth exemplary embodiment shown in FIG. 9, the force transmitting member 319 is intended to prevent the tappet 304, if the switch head comes loose from the switch housing 301, from being displaced away from the switch, i.e. upward in terms of FIG. 9, by the force of the restoring spring. In this exemplary embodiment as in the exemplary embodiment of FIG. 8, the feeler member 318 is embodied as a pivotably supported lever, which as long as the switch head is properly connected to the switch housing 301 forms an acute angle with the longitudinal axis of the tappet 304. If the switch head comes loose from the switch housing 301, then a spring 321 braced against the switch housing 301 pivots away from the tappet 304 until it contacts a stop 322, which is formed by a material portion of the switch housing 301. In this pivoting motion, a force transmitting member 319 embodied integrally with the feeler member 318 and protruding at an angle from the feeler member 318 comes into range of the path of motion of the stop face 320. This prevents the tappet 304 from moving so far away from the switch, that is, upward in terms of FIG. 9, that the switch would reach its actuation position. The particular advantage of this exemplary embodiment is that the force of the spring 321 can be very slight. It can be substantially less than the force of the restoring spring acting on the tappet 304, since it merely needs to pivot the feeler member 318 until the latter contacts the stop 322. The force of the restoring spring is then introduced into the stop 322 via the force transmitting member 319 and the feeler member 318.

Figure 10:
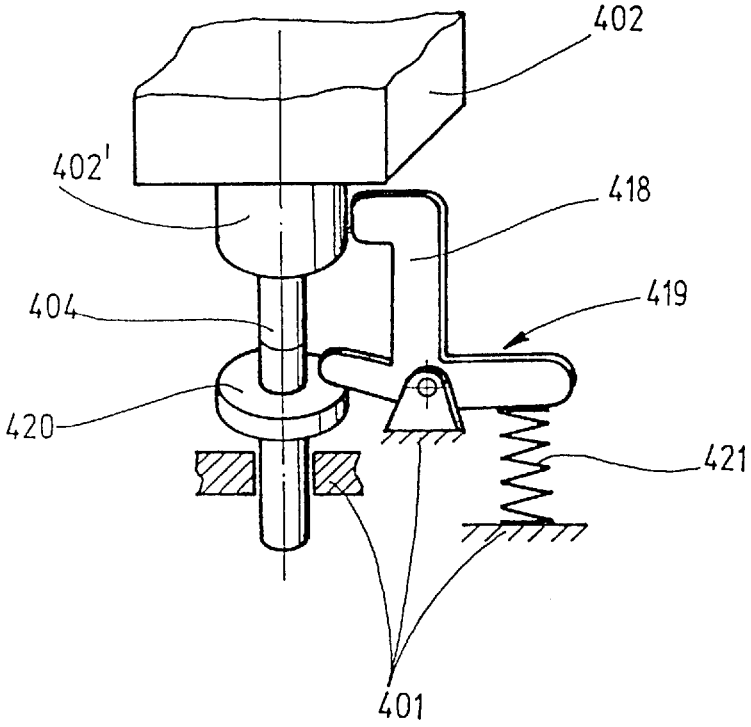
FIG. 10: a fragmentary, schematic illustration of a fifth exemplary embodiment.
Figure 1:
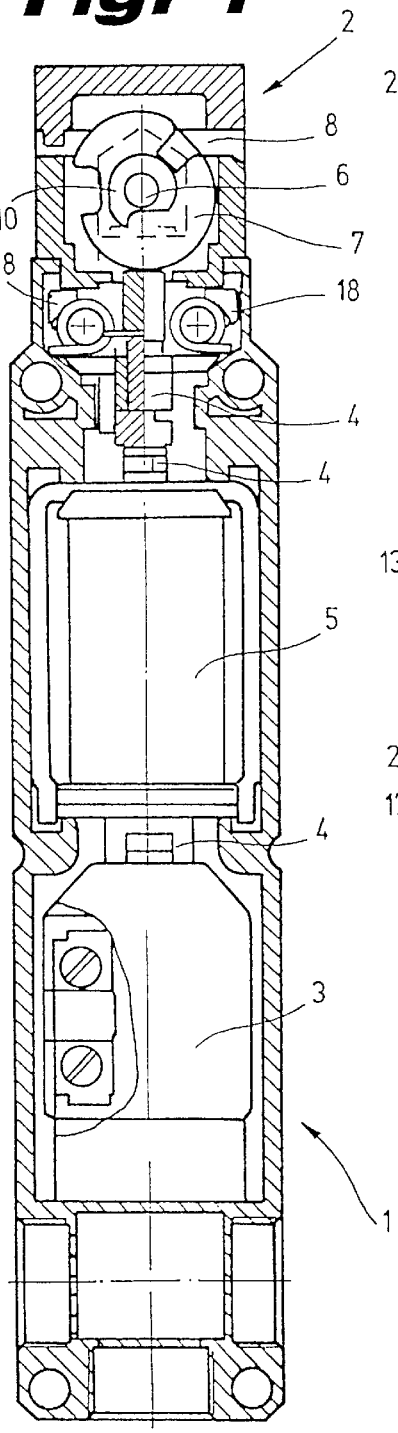
Figure 2:
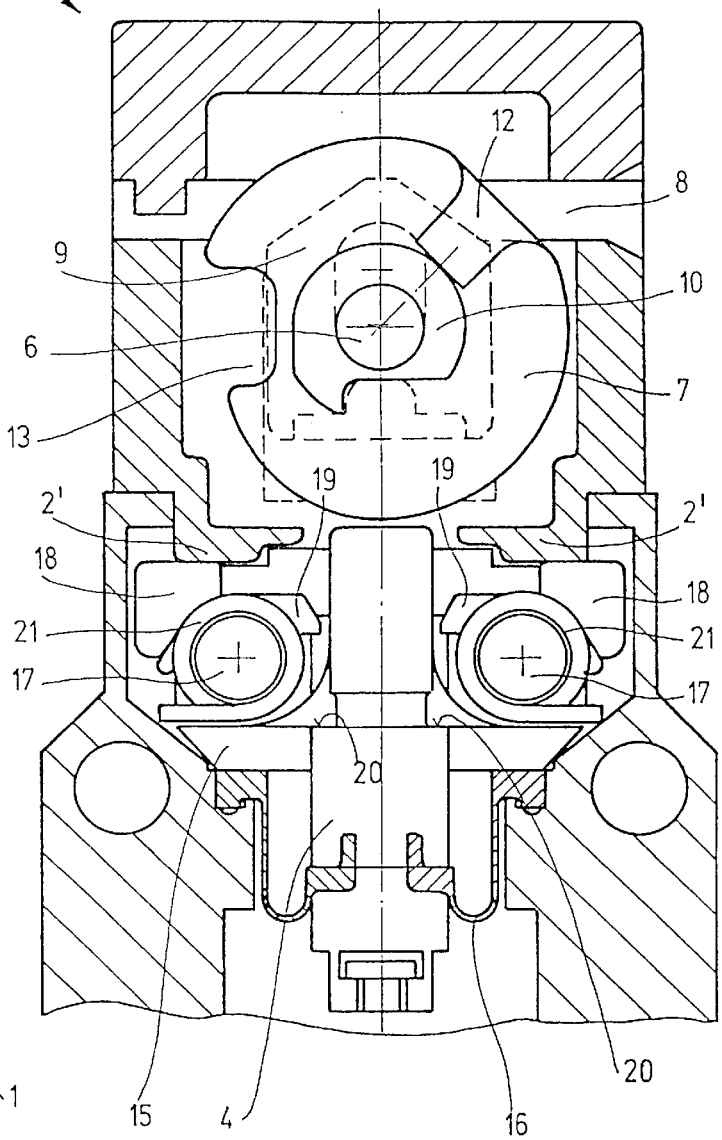
Figure 10:
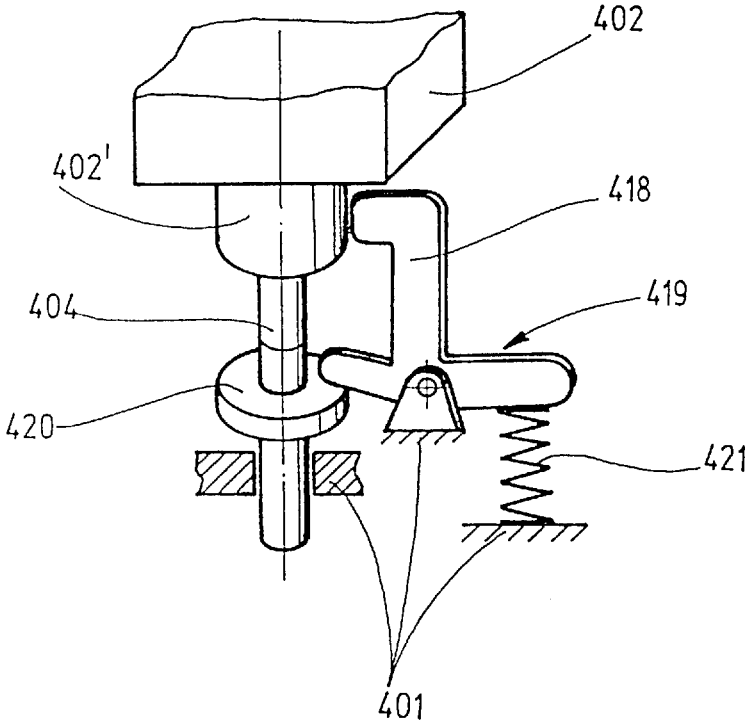

As FIG. 10 shows, the feeler member 418 may also be pressed by the force of the spring 421 associated with it transversely to the direction of motion of the switch actuating device, or in other words in the radial direction relative to the tappet 404, against a material portion 402' of the switch head 402. The feeler member 418 here, as FIG. 10 shows, takes the form of a bell crank, which protrudes from a double-armed pivot lever supported pivotably in the switch housing 401; specifically, it protrudes in such a way in this exemplary embodiment that its one, longer arm is approximately parallel to the tappet 404 if the free end of the feeler member 418 is in contact with the material portion 402' of the switch head 402. The double-armed pivot lever forms the force transmitting member 419. Its arm pointing away from the tappet 404 is acted upon by the spring 421 with a force oriented toward the switch head 402. Its arm toward the tappet 404 extends over a stop face 420 of the tappet 404. If the switch head 402 comes loose from the switch housing 401, then the spring 421 pivots not only the force transmitting member 419 but also the feeler member 418 counterclockwise, in terms of FIG. 10. The force transmitting member 419 thus keeps the tappet 404 in the position corresponding to the OFF state of the switch; or if the tappet has moved away that position, then it pushes the tappet into back into that position.

A particular advantage of this exemplary embodiment is that the bh puts practically no load on the fastening means that connect the switch head to the switch housing.

What is claimed is:

1. A safety switch for a guard device associated with a machine or a device, the safety switch comprising a switch housing; a switch head connected to said switch housing and having a drive device actuatable by a key insertable into and removable from said switch head; a switch actuating device which is displaceable counter to a restoring force into a position corresponding to a first switch position by an actuating force generated by said drive device and without the actuating force said restoring force assumes a position corresponding to a second switch position; a sensor detecting a presence and an absence of said switch head; and an actuator arranged in said switch housing and operating so that under control of said sensor in the event of loosening of said switch head from said switch housing exerts a force on said switch actuating device in a direction of motion counter to said restoring force, that is equal to or greater than said restoring force, depending on whether said switch actuating device is to be held in a previously assumed position or is to be returned thereto.

2. A safety switch as defined in claim 1, wherein said sensor has at least one mechanical feeler member for contacting with a material portion of said switch head.

3. A safety switch as defined in claim 2, wherein said actuator has at least one spring loader and at least one mechanical force transmitting member acted upon by said spring loader.

4. A safety switch as defined in claim 3, wherein said force transmitting member is formed as a pivot lever with a pivot path, said switch actuating device having a stop face located in said pivot path of said pivot lever.

5. A safety switch as defined in claim 3, wherein said feeler member is formed by one arm while said force-transmitting member is formed by another arm of a double-arm lever.

6. A safety switch as defined in claim 5, wherein said double-arm lever has a bearing trunnion around which a spring which forms said spring loader wraps, one end of said spring being supported on said switch housing while another end of said spring being supported on said double-arm lever spaced apart from a pivot axis of said double-arm lever.

7. A safety switch as defined in claim 3; and further comprising a second force transmitting member, said force transmitting members being disposed on said switch housing, distributed over a circumference of said switch actuating device.

8. A safety switch as defined in claim 7, wherein said force transmitting members are formed identically and located symmetrically to said switch actuating device.

9. A safety switch as defined in claim 3, wherein said spring loader has a force on said switch head which is reinforced by a force or a force component oriented in a direction of motion of said switch actuating device.

10. A safety switch as defined in claim 3, wherein said spring loader has a force on said switch head which is reinforced by a force or a main force component oriented transversely to a direction of motion of said switch actuating device.

11. A safety switch as defined in claim 2, wherein said feeler member is formed as a barrier element, which when there is said switch head, keeps said force transmitting member in an inactivated state.

* * * * *

United States Patent [19]

Bächle

[11] Patent Number: 5,868,243

[45] Date of Patent: Feb. 9, 1999

[54] SAFETY SWITCH ASSEMBLIES

[75] Inventor: Erik Bächle, Filderstadt, Germany

[73] Assignee: Euchner & Co., Leinfelden-Echterdingen, Germany

[21] Appl. No.: 913,939

[22] PCT Filed: Jan. 9, 1997

[86] PCT No.: PCT/EP97/00061

§ 371 Date: Sep. 22, 1997

§ 102(e) Date: Sep. 22, 1997

[87] PCT Pub. No.: WO97/27603

PCT Pub. Date: Jul. 31, 1997

[30] Foreign Application Priority Data

Jan. 26, 1996 [DE] Germany ..... 196 02 690.3

[51] Int. Cl.[6] ..... H01H 27/00

[52] U.S. Cl. ..... 200/334; 200/17 R; 200/61.62; 200/43.07

[58] Field of Search ..... 200/17 R, 43.01, 200/43.04–43.09, 61.62–61.68, 334

[56] References Cited

U.S. PATENT DOCUMENTS 4,963,706 10/1990 Mohtasham ..... 200/334

5,464,954 11/1995 Kimura et al. ..... 200/61.62

5,516,993 5/1996 Wecke et al. ..... 200/17 R 5,587,569 12/1996 Mohtasham ..... 200/17 R

*Primary Examiner*—Michael A. Friedhofer

*Attorney, Agent, or Firm*—Michael J. Striker

[57] ABSTRACT

A safety switch for a guard device associated with a machine or a device, the safety switch has a switch housing, a switch head connected to the switch housing and having a drive device actuatable by a key insertable into and removable from the switch head, a switch actuating device which is displaceable counter to a restoring force into a position corresponding to a first switch position by an actuating force generated by the drive device and without this actuating force exerted by the restoring force assumes a position corresponding to a second switch position, a sensor detecting a presence and an absence of the switch head, and an actuator arranged in the switch housing and operating so that under a control of the sensor in the event of loosening of the switch head from the switch housing exerts a force on the switch actuating device in a direction of motion to the restoring force, that is equal to or greater than the restoring force, depending on whether the switch actuating device is to be held in a previously assumed position or is to be returned thereto.

11 Claims, 4 Drawing Sheets

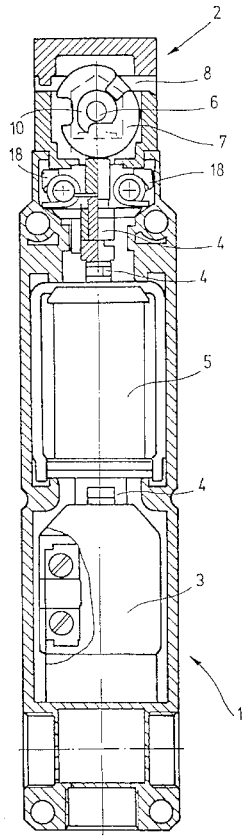

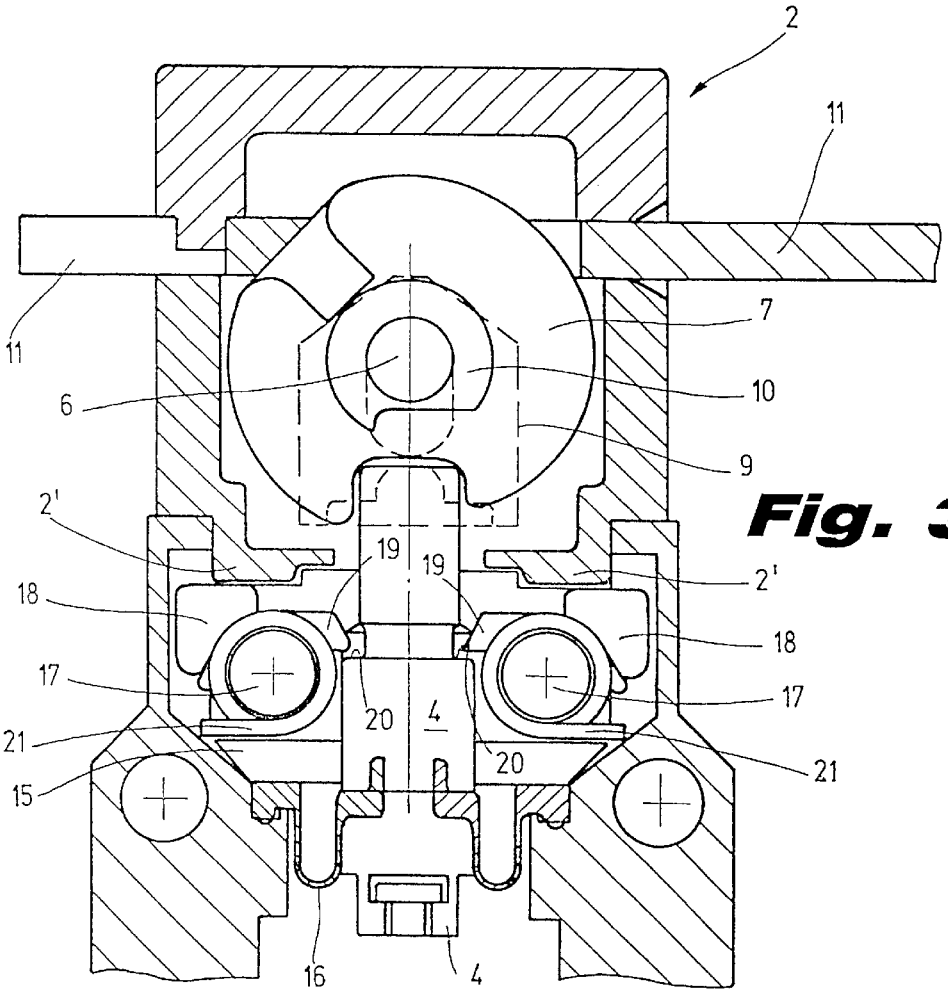
Fig. 3
Fig. 4
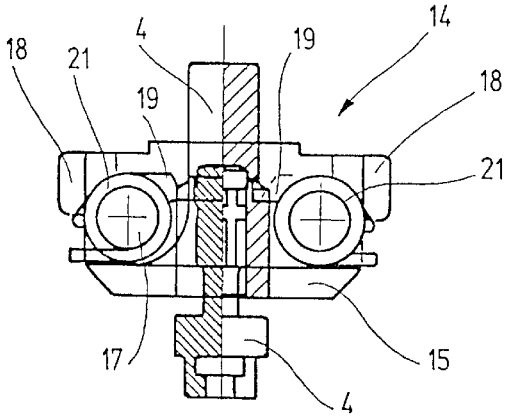
Fig. 5
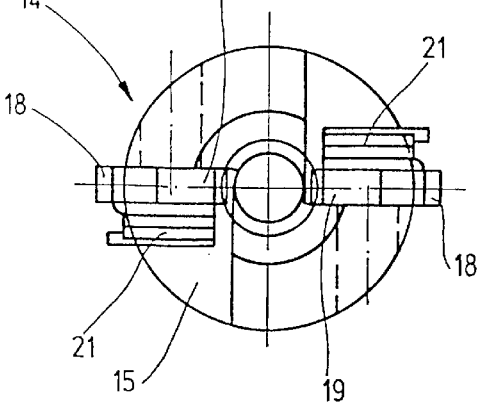

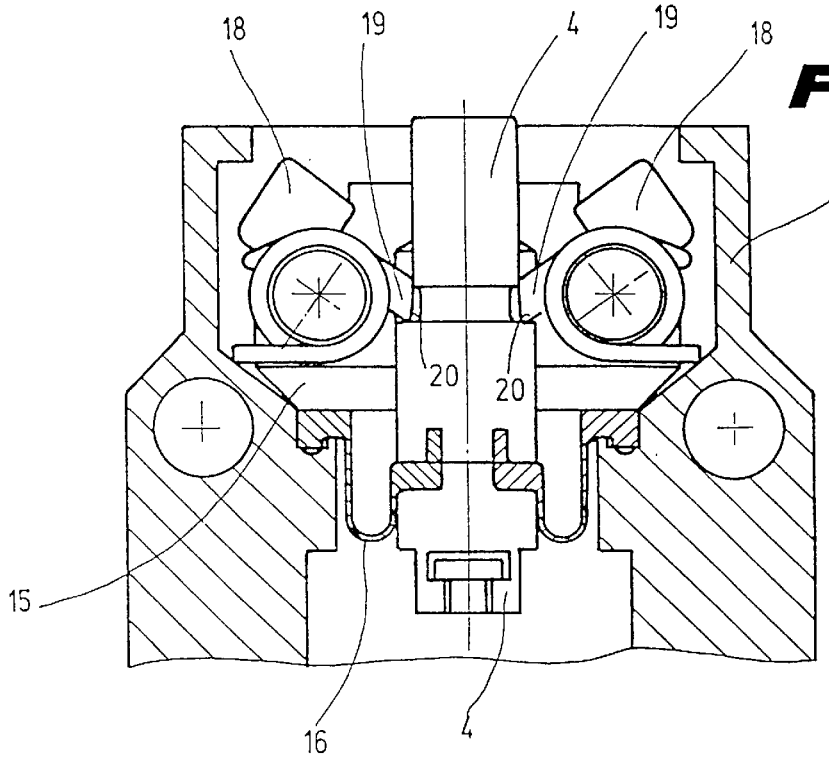
Fig. 6
Fig. 7
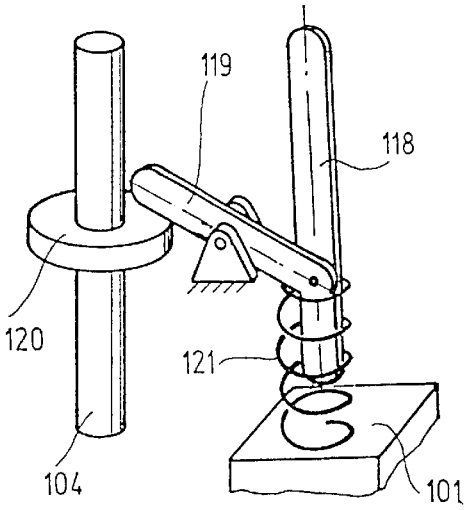
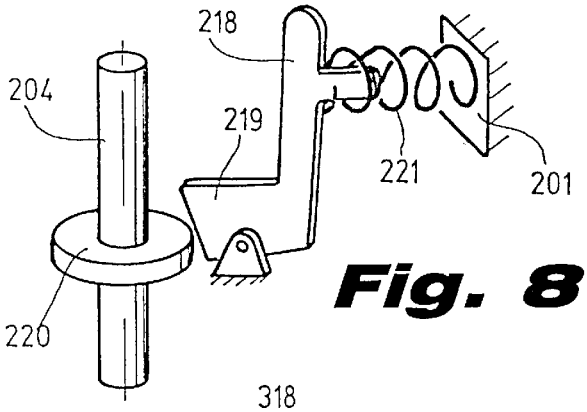
Fig. 8
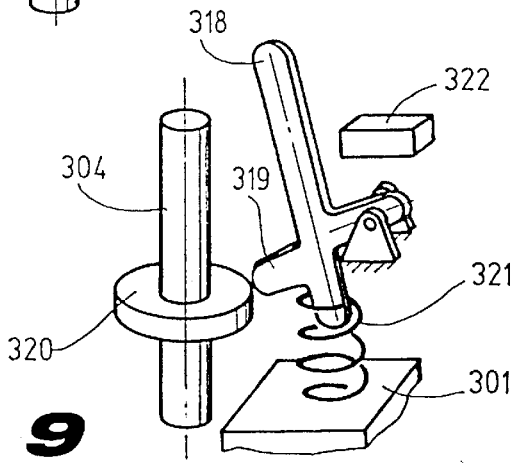
Fig. 9

SAFETY SWITCH ASSEMBLIES

BACKGROUND OF THE INVENTION

The invention relates to a safety switch for a guard device associated with a machine or device.

Guard devices of this type prevent persons from being able to get within the danger range of a machine or device as long as the machine or device is in operation. To that end, the door or the like that allows access is monitored by a safety switch, which allows the machine or device to be turned on only if the door or the like is closed, and which stops the machine or device if the door or the like is opened.

The known safety switches of the type referred to at the outset are actuated by means of a key, which can be introduced into a channel provided in the head of the switch and removed from it again. Both when the key is inserted into the switch head and when it is removed, a switchover of the switch takes place, in the one case preferably by compulsion, because of the force exerted on the key.

The known safety switches have the serious disadvantage that whenever the switch head comes loose from the switch housing, especially in response to externally exerted force, breakage occurs that causes disconnection; the tappet of the safety switch, because of the restoring force exerted on it, changes over to the switching state in which the machine or device can either be turned on or stays on. If the disconnection of the switch head from the switch housing occurs when the door or the like of the guard device is open or is being opened, then the protection sought by means of the guard device and the safety switch is entirely lacking.

SUMMARY OF THE INVENTION

It is therefore the object of the invention to create a safety switch of the type referred to at the outset that does not lose its safety function even if the switch head is disconnected from the switch housing. In accordance with the invention a sensor that detects the presence and absence of the switch head is provided, and an actuator is arranged in the switch housing under the control of the sensor and, in the event of loosening of the switch head from the switch housing, exerts a force on the switch actuating device in direction of motion counter to the restoring force, that is equal to or greater than the restoring force, depending on whether the switch actuating device is to be held in its previously assumed position or is to be returned thereto.

Thanks to the sensor that detects the presence and/or absence of the safety switch and to the actuator, disposed in the switch housing and controlled by this sensor, it is possible, if the switch head is disconnected from the switch housing, for the actuator to exert a force on the switch actuating device, on whose position the switching position of the switch depends, that either puts the switch in the OFF position or prevents the switch from changing over to the position in which the machine or device is, or can be, put into operation.

In a preferred embodiment, the sensor has at least one mechanical feeler member. It is understood that other sensors, such as optical or electrical sensors, can also be considered.

In the case of the actuator as well, a mechanical version is advantageous, for reasons of both cost and reliability; it is expedient for the actuating force to be made available by a spring loader. However, the actuator may also have or comprise other components, such as electromagnetic components.

In a mechanical version of the actuator, an embodiment of the force transmitting member as a pivot lever, in whose pivot path a stop face of the switch actuating device is located, is especially advantageous.

In the case of a mechanical feeler member, this member is preferably embodied as a barrier element that, when there is a switch head, keeps the force transmitting member in its inactivated state and does not enable it until the feeler member ascertains the separation of the switch head from the switch housing.

The actuator is especially simple and space-saving if the feeler member is formed by one arm, and the force transmitting member by the other arm, of a double-armed lever. In that case, a spring forming the spring loader can wraps around a bearing trunnion serving to support the double-armed lever and can be supported by one end on the switch housing and by its other end on the double-armed lever.

In a preferred embodiment, at least two force transmitting members, advantageously embodied identically, are provided, which are disposed on the switch housing, distributed over the circumference of the switch actuating device, advantageously symmetrically to the switch actuating device.

The supporting of the force of the spring loader on the switch head can be selected to meet the needs involved. If a support such that the force or the main force component oriented transversely to the direction of motion of the switch actuating device, puts an excessive load on the typically screw-type connection of the switch head to the switch housing, as may happen for instance in the case of a plastic switch housing with threaded bores machined into it, then the support can also be provided such that the force or main force component is oriented in the radial direction of the tappet.

The invention is described in detail below in terms of exemplary embodiments shown in the drawing.

BRIEF DESCRIPTION OF THE DRAWINGS

FIG. 1: enlarged longitudinal section through a first exemplary embodiment without an associated key;

FIG. 2: a detail of FIG. 1 shown on a larger scale;

FIG. 3: a fragmentary longitudinal section through the first exemplary embodiment with the key inserted into the switch head;

FIG. 4: a view, shown partly in section, of the actuator of the first exemplary embodiment and the part of the tappet actuated by the actuator when the switch head is present;

FIG. 5: a plan view on the actuator of FIG. 4;

FIG. 6: a fragmentary longitudinal section through the first exemplary embodiment with the switch head missing;

FIG. 7: a fragmentary, schematic illustration of a second exemplary embodiment;

FIG. 8: a fragmentary, schematic illustration of a third exemplary embodiment;

FIG. 9: a fragmentary, schematic illustration of a fourth exemplary embodiment;

FIG. 10: a fragmentary, schematic illustration of a fifth exemplary embodiment.

DESCRIPTION OF PREFERRED EMBODIMENTS

As FIG. 1 shows, a safety switch for a guard device associated with a machine or device, the guard device having a door or the like which in the closed state prevents a person from being able to get within the danger range of the machine or device, has a parallelepiped switch housing 1, which in the exemplary embodiment is of plastic but which could also be of metal. One end of the switch housing 1, the upper end in terms of FIG. 1, is adjoined by a switch head 2, which is connected to the switch housing 1 via screws, not shown. The switch housing 1, fixed for example to the stationary frame of the door or guard device to be monitored, includes a switch 3 that is located in the control current circuit of the machine or device. For the actuation of the switch 3, a tappet 4 is supported longitudinally displaceably in the switch housing 1; it extends from the switch 3 toward the switch head 2 and penetrates a magnet coil 5 fixedly disposed in the switch housing 1. The portion of the tappet 4 that penetrates this magnet coil 5 is embodied as an armature over part of its length; when the magnet coil 5 is excited, the armature is pulled into the magnet coil 5 toward the switch 3, counter to the force of a restoring spring, not shown, and held in that position. The magnet coil 5 is needed only if there is a need to prevent the possibility that the door or the like can be opened immediately after the machine or device is turned off. If there is no need for the safety switch to continue blocking the door or the like for a certain period of time after the machine or device has been turned off, then the magnet coil 5 can be omitted, without otherwise impairing the function of the safety switch.

An eccentric disk 7, which protrudes into a key channel 8 that penetrates the switch head 2, is rotatably supported on a shaft 6 that intersects the longitudinal axis of the tappet 4 at a right angle One slide 9, displaceable in the longitudinal direction of the tappet 4, is disposed on each of the two sides of the eccentric disk 7 and is provided with an oblong slot through which the shaft 6 can pass. The two slides 9, whose gable-like upper end portions each likewise protrude into the key channel 8 when the slides 9 are in the barrier position in which springs, not shown, seek to hold them, each cooperate with one cam disk 10 that is connected in a manner fixed against relative rotation to the eccentric disk 7 and that secures the slides, in their barrier position, against counterclockwise rotation, in terms of FIGS. 1 and 2, of the eccentric disk 7, in order to prevent the safety switch from being actuatable by any means other than its assigned key 11, which is disposed on the guard device door to be monitored in such a way that it enters the key channel 8 when the door is closed. The key 11 is embodied such that on entering the key channel 6, it first displaces the two slides 9 so far toward the switch housing 1 that they release the cam disks 10, and thus the eccentric disk 7 as well, to rotate clockwise in terms of FIGS. 1 and 2. A cross member of the key 11 then comes into engagement with a groove 12 of the eccentric disk 7 and rotates the latter into the angular position shown in FIG. 3.

In this angular position, the upper end of the tappet 4, which before the key 11 is inserted into the key channel 8 rests on a raised portion of the control curve formed by the circumference of the eccentric disk 10, can drop into a second groove 13 of the eccentric disk 7 that forms a low portion of the control curve. Both the contact of the tappet end with the raised portion of the control curve and the dropping into the second groove 13 with the attendant longitudinal displacement of the tappet 4 are effected by the prestressed spring that acts upon the tappet 4. In this longitudinal displacement of the tappet 4, the switch changes from its opened state to its closed state, so that, with the door closed, the machine or device can be put into operation.

The sides of the second groove 13 are so steep that the end of the tappet cannot be moved out of the second groove 13 by a rotation of the eccentric disk 7. The blockage of the control disk 7 prevents the key 11 from being removable from the key channel 7 and prevents the door that is to be secured from being openable as long as the machine or device is in operation, and accordingly as long as access to it must be precluded. Not until the machine or device is turned off, and preferably not until it has also come to a complete stop, is the magnet coil 5 excited; this causes the tappet 4 to move far enough in the opening direction of the switch 3, or in other words downward in terms of FIGS. 1–3, that the end of the tappet releases the eccentric disk 7. Only now can the key 11 be pulled out of the key channel 8, and only now can the door or the like that has the key 11 be opened. Thanks to the raised portion of the control curve of the eccentric disk 7, the magnet coil 5 can be turned off as soon as the tappet 4 can be retained, by the raised portion of the control curve, in the position that keeps the switch 3 in the opened state.

Inserted into the end portion of the switch housing 1 adjacent the switch head 2 is an actuator, identified overall by reference numeral 14, which has a carrier 15 that has a central through opening for the tappet 4. The carrier 15 is fixedly connected to the switch housing 1. A roll diaphragm seal 16 contacting its underside is tightly joined on the other side to the tappet 4 and thereby protects the interior of the switch housing 1 from invasion by external factors that could cause problems. Located diametrically to the through opening for the tappet, the carrier 5 has two bearing trunnions 17, at the same level and parallel to one another, extending toward the shaft 6; one double-armed pivot lever of the actuator 14 is rotatably supported on each of these trunnions. As FIG. 5 shows, the two pivot levers are located in the same radial plane, which is also the plane in which the longitudinal axis of the tappet 4 is located. The two arms of the pivot lever pointing away from one another each form one feeler member 18; as particularly shown in FIGS. 2 and 3, as long as the switch head 2 is properly connected to the switch housing 1 and rests on it, each feeler member rests on the face toward the actuator 14 of a respective material portion 2' of the switch head 2. In this angular position of the feeler member 18, the other arm, forming a force transmitting member 19, of each of the two pivot levers extends toward the tappet 4. The free end of each of the two force transmitting members 19, as shown in FIGS. 2 and 3, extends over a respective stop face 20 formed by one shoulder of the tappet 4. If, as shown in FIG. 3, the upper end of the tappet 4 is in engagement with the second groove 13, or in other words if the switch 3 is in the closed state, then the stop face 20 of the tappet 4 is spaced only slightly apart from the force transmitting members 19 and is within pivoting range of them.

A torsion spring 21 is disposed on each of the two bearing trunnions 17 of the actuator 14; it is braced on one end against the carrier 15 and on the other against the feeler member 18. The two prestressed torsion springs 21 not only have the task of keeping the feeler member 18 in contact with the associated material portion 2' of the switch head 2, from which it can then pivot into a different angular position, shown in FIG. 6, if for any reason the switch head 2 separates from the switch housing 1. In addition, in such a case, both the force transmitting members 19, which in the aforementioned pivoting motion of the feeler members 18 come into contact with the stop face 20, must displace the tappet 4 toward the switch 3, in order to open the switch. The force of the two torsion springs 21 together must therefore be greater than the force of the restoring force acting on the tappet 4. As FIG. 6 shows, the two force transmitting members 19 remain in contact with the stop face 20 and thereby keep the switch 3 in the opened state, in which the machine or device is stopped or cannot be turned on. Although the monitored door of the guard device can be opened if the switch head 2 has separated from the switch housing 1, still there can be no danger to human beings, because of the opening of the switch 3 by the actuator 14.

Instead of a feeler member in the form of a pivot lever, it is possible for instance, as the exemplary embodiment of FIG. 7 shows, to provide a feeler member 118 in the form of a bar that is disposed, longitudinally displaceably, parallel to the tappet 104 in the switch housing. The translational motion of the feeler member 118 can be transmitted, for instance by means of a force transmitting member 119 in the form of a double-armed pivot lever, to the tappet 104, which as in the first exemplary embodiment is provided with a stop face 120 which can be contacted by the free end of the force transmitting member 119. The contact of the feeler member 118 with a material portion of the switch head and, if the latter should come loose from the switch housing, the displacement of the tappet 104 into the position corresponding to the opened position of the switch is accomplished, as in the first exemplary embodiment, by means of a spring loader, which is formed for instance by a prestressed helical compression spring 121, which is supported by one end on the feeler member 118 and by the other on the switch housing 101.

The load put on the screws or other fasteners that connect the switch head to the switch housing by the force of the spring or springs forming the spring loader of the actuator can be reduced by providing a bell crank, for instance, one arm of which forms the feeler member 218 and the other arm of which forms the force transmitting member 219. A spring 221 forming the spring loader urges the feeler member 218 transversely to its longitudinal direction, as FIG. 8 shows. The bar-like feeler member 218 then, when it rests on the switch head, forms an acute angle with the longitudinal axis of the tappet 204. If the switch head comes loose from the switch housing, then the spring 221, braced on the switch housing 201 laterally beside the feeler member 218, pivots the feeler member 218 counterclockwise, in terms of FIG. 2, toward the tappet 204. As a consequence of this pivoting motion, the force transmitting member 219 comes to rest on the stop face 220 of the tappet 204 and moves it into the position in which the switch is opened. The force transmitting member 218 could extend over the stop face 220, as shown in FIG. 7. In this exemplary embodiment, however, it comes into contact with the edge of the stop face 220 by its face end that extends at an acute angle to the longitudinal axis of the tappet 204, and as a result once again a force oriented toward the switch is exerted on the tappet 204.

In the fourth exemplary embodiment shown in FIG. 9, the force transmitting member 319 is intended to prevent the tappet 304, if the switch head comes loose from the switch housing 301, from being displaced away from the switch, i.e. upward in terms of FIG. 9, by the force of the restoring spring. In this exemplary embodiment as in the exemplary embodiment of FIG. 8, the feeler member 318 is embodied as a pivotably supported lever, which as long as the switch head is properly connected to the switch housing 301 forms an acute angle with the longitudinal axis of the tappet 304. If the switch head comes loose from the switch housing 301, then a spring 321 braced against the switch housing 301 pivots away from the tappet 304 until it contacts a stop 322, which is formed by a material portion of the switch housing 301. In this pivoting motion, a force transmitting member 319 embodied integrally with the feeler member 318 and protruding at an angle from the feeler member 318 comes into range of the path of motion of the stop face 320. This prevents the tappet 304 from moving so far away from the switch, that is, upward in terms of FIG. 9, that the switch would reach its actuation position. The particular advantage of this exemplary embodiment is that the force of the spring 321 can be very slight. It can be substantially less than the force of the restoring spring acting on the tappet 304, since it merely needs to pivot the feeler member 318 until the latter contacts the stop 322. The force of the restoring spring is then introduced into the stop 322 via the force transmitting member 319 and the feeler member 318.

As FIG. 10 shows, the feeler member 418 may also be pressed by the force of the spring 421 associated with it transversely to the direction of motion of the switch actuating device, or in other words in the radial direction relative to the tappet 404, against a material portion 402' of the switch head 402. The feeler member 418 here, as FIG. 10 shows, takes the form of a bell crank, which protrudes from a double-armed pivot lever supported pivotably in the switch housing 401; specifically, it protrudes in such a way in this exemplary embodiment that its one, longer arm is approximately parallel to the tappet 404 if the free end of the feeler member 418 is in contact with the material portion 402' of the switch head 402. The double-armed pivot lever forms the force transmitting member 419. Its arm pointing away from the tappet 404 is acted upon by the spring 421 with a force oriented toward the switch head 402. Its arm toward the tappet 404 extends over a stop face 420 of the tappet 404. If the switch head 402 comes loose from the switch housing 401, then the spring 421 pivots not only the force transmitting member 419 but also the feeler member 418 counterclockwise, in terms of FIG. 10. The force transmitting member 419 thus keeps the tappet 404 in the position corresponding to the OFF state of the switch; or if the tappet has moved away that position, then it pushes the tappet into back into that position.

A particular advantage of this exemplary embodiment is that the bh puts practically no load on the fastening means that connect the switch head to the switch housing.

What is claimed is:

1. A safety switch for a guard device associated with a machine or a device, the safety switch comprising a switch housing; a switch head connected to said switch housing and having a drive device actuatable by a key insertable into and removable from said switch head; a switch actuating device which is displaceable counter to a restoring force into a position corresponding to a first switch position by an actuating force generated by said drive device and without the actuating force said restoring force assumes a position corresponding to a second switch position; a sensor detecting a presence and an absence of said switch head; and an actuator arranged in said switch housing and operating so that under control of said sensor in the event of loosening of said switch head from said switch housing exerts a force on said switch actuating device in a direction of motion counter to said restoring force, that is equal to or greater than said restoring force, depending on whether said switch actuating device is to be held in a previously assumed position or is to be returned thereto.

2. A safety switch as defined in claim 1, wherein said sensor has at least one mechanical feeler member for contacting with a material portion of said switch head.

3. A safety switch as defined in claim 2, wherein said actuator has at least one spring loader and at least one mechanical force transmitting member acted upon by said spring loader.

4. A safety switch as defined in claim 3, wherein said force transmitting member is formed as a pivot lever with a pivot path, said switch actuating device having a stop face located in said pivot path of said pivot lever.

5. A safety switch as defined in claim 3, wherein said feeler member is formed by one arm while said force-transmitting member is formed by another arm of a double-arm lever.

6. A safety switch as defined in claim 5, wherein said double-arm lever has a bearing trunnion around which a spring which forms said spring loader wraps, one end of said spring being supported on said switch housing while another end of said spring being supported on said double-arm lever spaced apart from a pivot axis of said double-arm lever.

7. A safety switch as defined in claim 3; and further comprising a second force transmitting member, said force transmitting members being disposed on said switch housing, distributed over a circumference of said switch actuating device.

8. A safety switch as defined in claim 7, wherein said force transmitting members are formed identically and located symmetrically to said switch actuating device.

9. A safety switch as defined in claim 3, wherein said spring loader has a force on said switch head which is reinforced by a force or a force component oriented in a direction of motion of said switch actuating device.

10. A safety switch as defined in claim 3, wherein said spring loader has a force on said switch head which is reinforced by a force or a main force component oriented transversely to a direction of motion of said switch actuating device.

11. A safety switch as defined in claim 2, wherein said feeler member is formed as a barrier element, which when there is said switch head, keeps said force transmitting member in an inactivated state.

* * * * *